United States Patent [19]

Notermann

[11] Patent Number: 4,460,344

[45] Date of Patent: Jul. 17, 1984

[54] WATER SKI TRAINING APPARATUS

[75] Inventor: Walter F. Notermann, Victoria, Minn.

[73] Assignee: Lake Region Products, Inc., Victoria, Minn.

[21] Appl. No.: 398,450

[22] Filed: Jul. 14, 1982

[51] Int. Cl.[3] ..... A63C 11/00

[52] U.S. Cl. ..... 441/73; 434/253

[58] Field of Search ..... 434/253; 441/68, 69, 441/72, 73; 280/817, 818, 480, 493; 272/97

[56] References Cited

U.S. PATENT DOCUMENTS

| | | | |
|---|---|---|---|
| 1,601,270 | 9/1926 | Tippett | 280/480 |
| 2,938,220 | 5/1960 | Puckett | 441/73 |
| 2,946,305 | 7/1960 | Hill | 441/73 X |
| 2,950,923 | 8/1960 | Forney | 441/73 X |
| 3,066,328 | 12/1962 | Jones | 441/73 |
| 3,098,247 | 7/1963 | Stein | 441/72 |
| 3,142,075 | 7/1964 | Hill | 441/73 |
| 3,264,663 | 8/1966 | Owens | 441/73 |
| 3,271,049 | 9/1966 | Schoonmaker | 280/480 X |
| 3,830,188 | 8/1974 | Humbert | 441/69 |
| 3,907,320 | 9/1975 | Charneck | 280/818 |

*Primary Examiner*—Harland S. Skogquist

*Attorney, Agent, or Firm*—Burd, Bartz & Gutenkauf

[57] ABSTRACT

A training apparatus for the sport of water skiing comprising, in combination: a pair of water skis; a first connection near the fronts of said skis and a second connection near the backs of said skis for maintaining the skis generally parallel with a predetermined mutual spacing; a handle rope fixed at one end to the first connection and having a gripping handle at the other end; and a towing rope connected to the first connection for providing forward impulsion to the skis.

17 Claims, 4 Drawing Figures

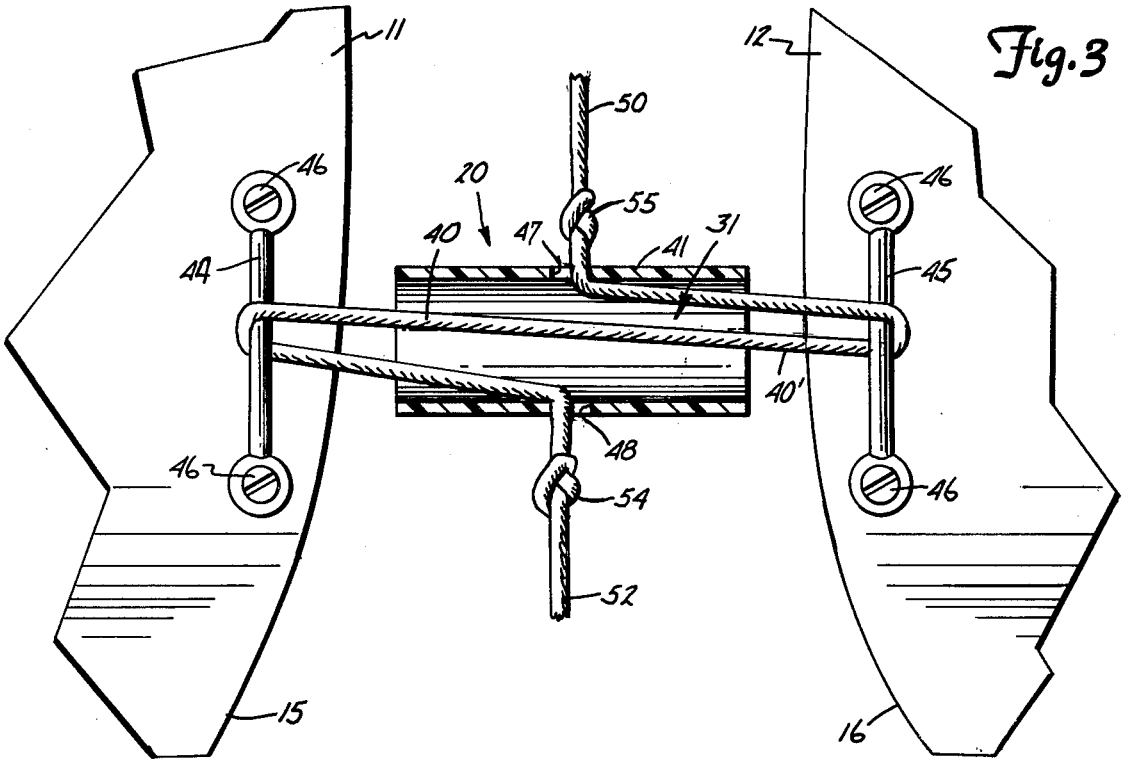
Fig.3
Fig.4
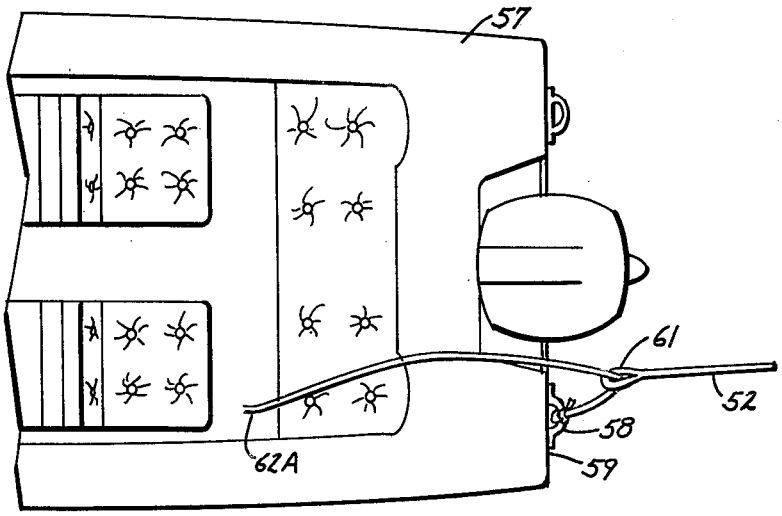

WATER SKI TRAINING APPARATUS

TECHNICAL FIELD

This invention relates to the field of water sports, and particularly to an apparatus for use in training beginners in the sport of water skiing.

BACKGROUND OF INVENTION

Water skiing is an enjoyable sport, but like most sports requires the beginner to go through a learning process for training the body in the necessary skills. As in all learning of physical skills, the process is one of trial and error, and in this case the error generally results in a fall of the learner into the water. Such falls may be quite frightening to younger persons, and should be made as easy and infrequent as possible.

Of particular difficulty to the novice participant of the sport is maintaining the water skis in proper parallel spaced apart relationship. During the start up procedure, when the water skier accelerates from a position of rest to a planning speed, there is sometimes a propensity for the ski tips to spread apart resulting in a loss of balance of the skier. During the acceleration procedure, the novice water skier exerts substantially more effort than the accomplished skier due to the greater time consumed in getting up, and the tendency of the novice to "plow" through the water.

Once up and satisfactorily moving over the water, the novice can encounter problems of balance, of a tendency of the rear portions of the skis to spread apart, and of one ski falling behind another.

BRIEF SUMMARY OF INVENTION

The present invention comprises an apparatus for maintaining a pair of water skis in the proper mutual relation, relieving the user of direct towing force, and assisting the user in learning the correct forward balance. The apparatus is used with a technique for reliably separating the user and skis from the towing boat if the user should fall.

A pair of water skis is provided with connecting means connecting the forward portions of the water skis and connecting the rearward portions of the water skis to maintain them in proper parallel spaced apart relationship. The connecting means includes flexible elements which permit a measure of individual rotation of each ski about its own longitudinal axis as when executing a gentle turn. The flexible elements of the connecting means also allow some variation in the spacing between the skis while rigid compression portions of the connecting means limit the minimum spacing between the skis. A tow line is connected at one end to the forward connecting means between the skis and is releasably connected to the tow boat at the other end. A handle assembly is fastened to the forward connecting means and includes a handle to be grasped by the user so that the user can learn balance and coordination.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

IN THE DRAWINGS

In the drawings, in which like reference numerals identify corresponding parts throughout the several views, FIG. 1 is a plan view of a water skiing training apparatus according to the invention;

FIG. 3 is an enlarged detail partly in section of a portion of the training apparatus showing the forward connecting means of FIG. 1;

FIG. 4 is a top plan view of the releasable connection of the training apparatus to a tow boat.

DESCRIPTION OF PREFERRED EMBODIMENT

Figure 1:
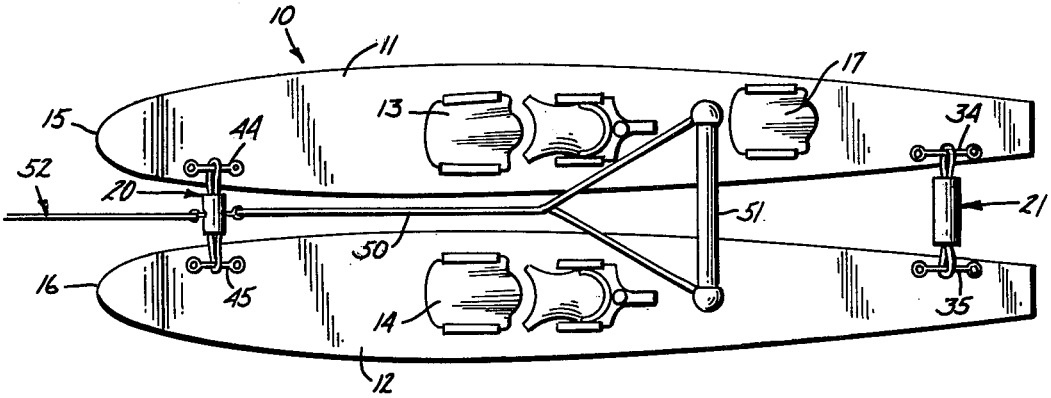

Referring to the drawings, there is shown in FIG. 1 a pair of first and second water skis 11 and 12 having adjustable foot bindings 13, 14 and a slalom toe pocket 17. Water skis 11, 12 have the usual upwardly turned convergent forward tips 15, 16 and rear vertical downward stabilizing fins (not shown). A first or forward connecting means 20 is provided for connection of the forward portion of water skis 11, 12 at first and second rearward connecting points to hold the water skis in parallel, spaced apart relationship within desired spacing limits. The connecting points are symmetrically positioned on the first and second skis. Water skis 11, 12 are connected together for the benefit of the novice water skier so that they will not converge or diverge at the forward or rearward portions particularly during the acceleration process of getting established on the water skis but also throughout the water ski trip.

Figure 2:
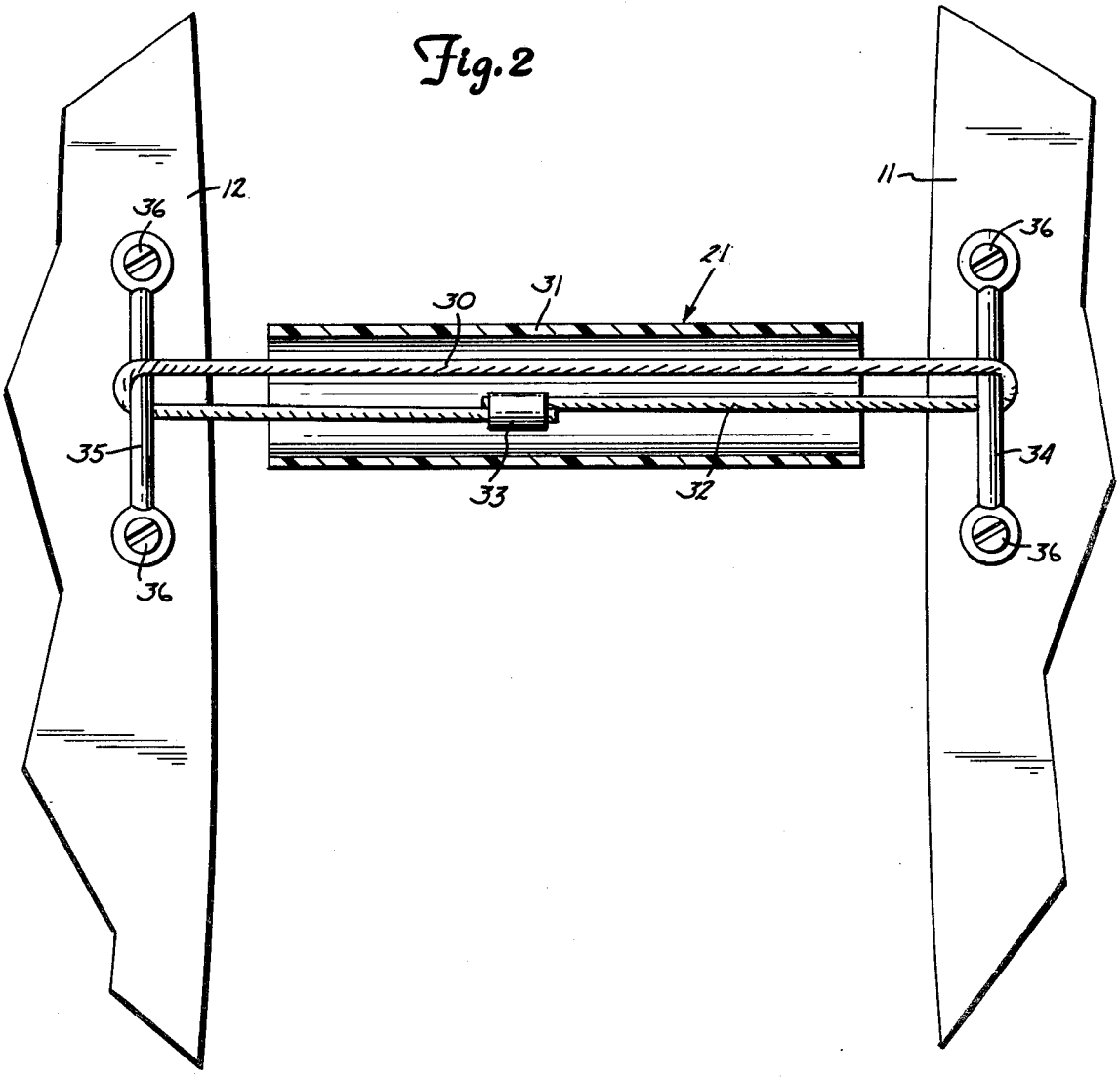
FIG. 2 is an enlarged detail partly in section of a portion of the training apparatus showing the rearward connecting means of FIG. 1.

As shown in FIG. 2, rearward connecting means 21 includes a flexible tension link 30 comprised as an endless loop formed of a length of suitable cable or cord 32 joined at its ends by the clamp 33. Anchors or eye straps 34, 35 are fastened by screws 36 to the upper surface of skis 11, 12 at the rear portion thereof adjacent confronting edges. The ends of loop 30 engage eye straps 34, 35. A relatively rigid compression element or sleeve 31 encompasses the intermediate portion of flexible element 30 and serves as a spacer to fix the minimum distance permitted between skis 11, 12. Flexible link 30 is somewhat longer than sleeve 31 whereby the distance between the skis 11, 12 is variable within limits. Independent upward and downward movement of the skis is permitted as when riding over discrete waves, and the skis are permitted a limited degree of individual rotation about their respective longitudinal axes as during the execution of a turn or riding over waves.

As shown in FIG. 1, a handle rope 50 extends rearwardly from forward connecting means 20 terminating in a transverse rigid handle 51 to be grasped by the water skier. A tow rope 52 extends forward from forward connecting means 20 to a tow boat.

As shown in FIG. 3, forward connecting means 20 includes a flexible tension element 40 connected between anchors or eye straps 44, 45 mounted by screws 46 adjacent confronting forward edges of water skis 11, 12 forward of the foot bindings. A rigid compression element comprised as sleeve or spacer 41 encompasses the intermediate portion of flexible element 40 and serves to fix the minimum permissible spacing between the forward portions of water skis 11, 12 while the flexible element 40 fixes the maximum permissible spacing between the water skis.

In a preferred embodiment shown, the tow line 52 and handle line 50 are comprised as a single continuous line with flexible element 40 comprised as an intermediate portion 40' thereof located substantially within the confines of the sleeve 41. Sleeve 41 has diametrically opposed openings 47, 48 through which the intermediate line 40' extends. A first knot 54 is formed at the termination of the tow portion 52 of the continuous cable outside of the first or forward opening 47. A second knot 55 is formed at the base of the handle portion 50 of the continuous cable just outside of the second opening 48 of sleeve 41. The flexible element portion 40' of connecting means 20 is disposed between the first and second knots 54, 55. Variation of the position of the knots 54, 55 is effective to vary the length of the flexible tension element 40 comprised as the segment 40' which extends from the first knot 54 through the opening 47 in sleeve 41, is trained over the eye strap 45 on ski 16, then extends to and is trained over the eye strap 44 on ski 11, from there extending back into the sleeve 41 and through the opening 48 to the second knot 55. Variation of the location of the first and second knots 54, 55 is also effective to adjust the length of the handle line 50 as may be required by the stature of the water skier such that the water skier is comfortably disposed holding the handle 51 in a slightly forwardly bent position with the knees slightly flexed and the arms substantially straight. Flexible element 40 permits variation of the spacing between the skis within limits set by the length of intermediate portion 40' and the length of spacer 41. The skis can move upwardly and downwardly independent of one another within limits and can rotate about their individual longitudinal axis as when a turn being executed.

As shown in FIG. 4, the tow boat 57 has the usual eye bolts 58 mounted on the transom 59 thereof. The tow rope 52 terminates in an eye splice 61. An auxiliary line or release line 62 has one end fixd to the eye bolt 58 with a free end being trained through the eye splice 61. A free end 62A of the release line 62 is manually held by an observer in the tow boat who is able also to observe traffic and surface conditions. If the water skier falls or otherwise is imperiled, the observer simply releases the free end of the release rope 62, which slips through the splice 61 and releases the tow cable 52 so that forward motion of the water skier ceases.

In use, water ski training apparatus is usable by the novice to learn to water ski or by the advanced water skier to practice maneuvers such as turning around while in motion or carrying another person. The feet of the water skier are slipped into the properly adjusted foot bindings with the length of handle rope 50 adjusted to the stature of the skier. One of the most difficult elementary maneuvers for the novice water skier is the initial acceleration from a position of rest to a position of stable motion planning over the water surface whether the start is from the shore, in the water or from a dock. Difficulty is encountered because the water skis tend to part and tend to wobble during the initial acceleration phase. Connecting means 20, 21 of training apparatus 10 keeps the water skis 11, 12 in stable, side by side relationship but permit some amount of relative movement between the water skis as is necessary before turning and negotiating small waves. The towing force of the boat is applied through the knot 55 and is eventually borne by the eye straps 44, 45 rather than being taken directly by the skier. The supporting force for handle 51 is applied against the sleeve 41 by the knot 54.

As the water ski operation commences, an observer sitting in tow boat 57 holds the free end 62A of release line 62 which is trained through splice 61 of tow line 52. At such time as the water skier is about to fall or otherwise encounters trouble, the observer releases the free end of release line 62 which slips through the splice 61 to release the tow line 52 and halt further forward movement of the water skier.

While there has been shown and illustrated a certain preferred embodiment of a water ski training apparatus according to the invention, it will be apparent that certain deviations and alterations can be had without departing from the scope and spirit of the invention.

The embodiments of the invention in which an exclusive property or privilege is claimed are defined as follows:

1. A water ski training apparatus, comprising:

a first water ski and a second water ski;

first connecting means connecting portions of the first and second water skis at a first connection point on the first water ski and a second connection point on the second water ski positioned generally symmetrically to the first connection point on the first water ski;

said first connecting means including a flexible tension element extended between the first and second connection points limiting the maximum permissible spacing between the first and second connection points, and substantially rigid compression means limiting the minimum permissible spacing between the first and second connection points;

a water ski tow line connected to a first end of the flexible tension element, a second end of the flexible tension element being fixed to the substantially rigid compression means whereby a towing force exerted by the tow line is applied through the substantially rigid compression means and the first and second connecting points of the water skis.

2. The water ski training apparatus of claim 1 wherein: said first connecting means connects forward portions of the first and second water skis between first and second forward connection points; and including second connecting means connecting rearward portions of the first and second water skis at a first rearward connection point on the first water ski and a second rearward connection point on the second water ski positioned generally symmetrically to the first rearward connection point of the first water ski;

said second connecting means including means limiting the maximum permissible spacing between the first and second rearward connection points and limiting the minimum permissible spacing between the first and second rearward connection points.

3. The water ski training apparatus of claim 1 or 2 including: said tow line having a first end connected to the first connecting means and a second end extendible to a tow boat, said second end having an eye splice, and including a release line having one end fixable to a tow boat and a free end extendible through the eye splice to be held by an observer in the tow boat and selectively releasable by the observer to release the tow line.

4. The water ski training apparatus of claim 1 including: anchor means at said first and second forward connection points, said flexible tension element including a portion of a flexible line having loop ends, said loop ends being in engagement with the anchor means.

5. The water ski training apparatus of claim 1 wherein: said substantially rigid compression means including a substantially rigid compression element shorter than the flexible tension element.

6. The water ski training apparatus of claim 5 wherein: said compression element is constituted as a sleeve member encompassing an intermediate portion of the flexible tension element.

7. The water ski training apparatus of claim 6 including anchor means at said first and second forward connection points, said flexible tension element including a portion of a flexible line having loop ends, said loop end being in engagement with the anchor means.

8. The water ski apparatus of claim 2 including: first rearward anchoring means on the first water ski, second rearward anchoring means on the second water ski, said first and second rearward anchoring means being placed symmetrically on confronting rearward edges of the first and second water skis, said second connecting means including an endless loop line engaging the first and second rearward anchoring means and comprising said means limiting the maximum permissible spacing between the first and second connection points, and including a substantially rigid sleeve encompassing an intermediate portion of said endless loop and comprising the means limiting the minimum permissible spacing between the first and second connection points.

9. The water ski apparatus of claim 6 wherein: a portion of the tow line comprises the flexible tension element.

10. A water ski training apparatus, comprising:

a first water ski and a second water ski;

first connecting means connecting forward portions of the first and second water skis at a first connection point on the first water ski and a second connection point on the second water ski positioned generally symmetrically to the first connection point on the first water ski;

said first connecting means including a flexible tension element limiting the maximum permissible spacing between the first and second connection points and a substantially rigid compression sleeve member shorter than the flexible tension element and encompassing an intermediate portion of the flexible tension element to limit the minimum permissible spacing between the first and second connection points;

a tow line connected to the first connecting means and extendible to a tow boat;

anchor means at said first and second forward connection points, said tow line having a portion entering said sleeve through a forward lateral opening in the sleeve, said portion of the tow line comprising said flexible tension element being trained over the anchor means at the first connection point and extending to and being trained over the anchor means at the second connection point and extending back to the sleeve and being fixed to the sleeve.

11. The water ski apparatus of claim 10 including: knot means fixing the flexible tension element to the sleeve.

12. The water ski tow apparatus of claim 10 including: a handle line extending from the first connecting means, a handle bar fixed to the end of the handle line and adapted to be grasped by a water skier situated in the water skis.

13. The water ski apparatus of claim 12 wherein: said handle line is comprised as an extension of the portion of the tow line comprising the flexible tension element extending through a lateral opening in the rearward portion of the sleeve and including a first knot formed in the tow line outside of the sleeve adjacent the forward lateral opening through the sleeve, and a second knot formed in the tow line outside of the sleeve adjacent the rearward lateral opening to the sleeve.

14. The water ski training apparatus of claim 13 wherein: the end of the tow line extendible to a tow boat is equipped an eye splice and including a release line having one end fixable to the tow boat and a free end to be slipped through the eye splice of the tow line and held by an observer and selectively releasable by the observer to disconnect the tow line.

15. A water ski training apparatus comprising:

a pair of water skis;

first connecting means located near the forward ends of said skis including first and second anchoring means on the first and second skis and second connecting means near the rearward ends of said skis, for maintaining the skis generally parallel with a predetermined mutual spacing;

said first connecting means including a tubular sleeve with end openings and a pair of lateral side openings, and a flexible element partially enclosed by the sleeve with loop portions engaging the first and second anchoring means and ends extended through the side openings of the sleeve;

a handle rope fixed at one end to one end of the flexible element and having a gripping handle at the other end; and a towing rope connected to the other end of the flexible element for providing forward impulsion to the skis.

16. The apparatus according to claim 15 in which the second of said connecting means includes a flexible tension element and a rigid compression element.

17. The apparatus of claim 15 wherein: said handle rope and said towing rope are continuous, and including means fixing the contact side of said first connection means there along.

* * * * *